US005157414A

United States Patent [19]

Seino et al.

[11] Patent Number: 5,157,414

[45] Date of Patent: Oct. 20, 1992

[54] THICK FILM TYPE THERMAL HEAD AND THERMAL RECORDING DEVICE

[75] Inventors: Taisaku Seino, Ibaraki; Michihiro Watanabe, Tsuchiura; Munetoshi Zen; Kazutaka Sato, both of Kashiwa; Shigeru Obata; Maya Arai, both of Ibaraki; Kazuhiko Atou, Mito; Kentaro Hamma, Katsuta, all of Japan

[73] Assignee: Hitachi, Ltd., Tokyo, Japan

[21] Appl. No.: 563,694

[22] Filed: Aug. 7, 1990

[30] Foreign Application Priority Data

Sep. 8, 1989 [JP] Japan ..... 1-231611

[51] Int. Cl.[5] ..... B41J 2/335

[52] U.S. Cl. ..... 346/76 PH

[58] Field of Search ..... 346/76 PH; 219/543

[56] References Cited

U.S. PATENT DOCUMENTS 4,587,39 5/1986 Higeta et al. ..... 346/76 PH

FOREIGN PATENT DOCUMENTS 0084683 6/1980 Japan .
0089978 6/1982 Japan .
0089980 6/1982 Japan .
3203070 11/1983 Japan ..... 346/76 PH
0129273 7/1985 Japan ..... 346/76 PH
0029554 2/1986 Japan ..... 346/76 PH
0128849 5/1989 Japan .

*Primary Examiner*—Benjamin R. Fuller
*Assistant Examiner*—Huan Tran
*Attorney, Agent, or Firm*—Antonelli, Terry, Stout & Kraus

[57] ABSTRACT

A thick film type thermal head produced by consecutively forming, on an insulator substrate, a heat-resistant layer, an electrode, a heating resistor and a protective layer, wherein the protective layer comprises an electrically insulating protective layer covering the heating resistor and that portion of the electrically insulating protective layer which corresponds to a medium comprises a heat-diffusing coating having a high thermal conductivity over the electrically insulating protective layer.

15 Claims, 11 Drawing Sheets

(a) CONVENTIONAL HEAD (b) HEAD WITH A METAL FILM

THICK FILM TYPE THERMAL HEAD AND THERMAL RECORDING DEVICE

BACKGROUND OF THE INVENTION

This invention relates to a thermal recording device and a structure of a thick film type thermal head mounted thereon, and in particular, to a thermal head suitable for full-color high-quality images.

As disclosed in JP-A (Laid open, hereinafter, called as A)-55-84683 and JP-A-57-89980, when the protective layer of a thermal head is imparted with high thermal conductivity, it is conventional practice to form an abrasion-resistant layer on a protective layer surface of a thin film thermal head by sputtering or evaporating a substance having high hardness and high thermal conductivity thereon. The abrasion-resistant layer is intended to give an improved heat-transfer coefficient between the thermal head and a coloring medium.

A thick film type thermal head uses, in general, an electrode system of an alternate lead structure, and therefore has the following characteristic defect. When an image is printed, no current flows in a resistor positioned directly on the electrode. That is, that portion of the resistor which is positioned directly on the electrode generates no heat. Hence, a low-temperature area occurs on the thermal head surface, and a white streak appears on the printed image in a subscanning direction. Further, JP-A-1-128849 describes that the thermal efficiency is improved by incorporating a metal oxide into a protective glass of a thick film type thermal head.

A conventional thick film type thermal head uses, in general, an electrode system having an alternate lead structure. The use of this system has the following problem. When an image is printed, no current flows in that portion of the resistor which is positioned directly on the electrode as shown in FIG. 16, and isothermic lines on the resistor surface are therefore distributed concentrically about the central portion of a pixel as shown in, the Figure. A non-heat developing portion results in a low-temperature area and produces a white streak on the printed image in a subscanning direction. The subscanning direction means the direction in which a coloring medium is fed, and the main scanning direction means the direction which is at an right angle with the subscanning direction, i.e. the direction in which the heating resistors are arranged. An arrow mark in FIG. 16 shows the main scanning direction.

In prior techniques disclosed in JP-A-55-84683, JP-A-57-89978 and JP-A-57-89980, a high thermal conductivity layer having abrasion resistance is formed in order to improve thermal contact between a thermal head and a coloring medium. JP-A-1-128849 discloses incorporation of a metal oxide into a protective glass in order to improve heat efficiency, whereby the thermal conductivity of a protective layer is increased. However, it fails to take the following into consideration: nonuniformity in density caused by a temperature distribution difference on the heating resistor surface and abrasion between the thermal head surface and the coloring medium or resolution of a printed image.

SUMMARY OF THE INVENTION

It is an object of this invention to provide a smooth printed image by achieving a uniform temperature distribution in each of pixels on a thermal head surface, and to achieve this object without any reduction in image resolution.

It is another object of this invention to improve efficiency of heat transfer to a coloring medium and, at the same time, to reduce contact resistance between the thermal head and the coloring medium.

It is a further object of this invention to provide a thermal recording device for improvement of printed image quality and heat efficiency by mounting a thermal head having the above-specified functions.

According to this invention, there is provided a thick film type thermal head produced by consecutively forming, on an insulator substrate, a heat-resistant layer, an electrode, a heating resistor and a protective layer, wherein the protective layer comprises an electrically insulating protective layer covering the heating resistor, and that portion of the electrically insulating protective layer which corresponds to a medium comprises a heat-diffusing coating having a high thermal conductivity over the electrically insulating protective layer.

According to this invention, there is also provided a thick film type thermal head having a consecutive constitution, on an insulator substrate, of a heat-resistant layer, an electrode, a heating resistor and a protective layer, which is produced by forming a heat-diffusing coating on the upper surface of the heating resistor and then forming the protective layer thereon.

According to this invention, there is further provided a process for producing a thick film type thermal head having a consecutive constitution, on an insulator substrate, of a heat-resistant layer, an electrode, a heating resistor and a protective layer, wherein the protective layer is formed by a process which comprises forming an electrically insulating protective layer to cover the heating resistor and forming a heat-diffusing coating by printing a paste comprised mainly of a material having high thermal conductivity on the upper surface of the insulating protective layer by a screen printing method using a screen mask through which the paste can pass in any form or by discharging method of discharging and printing the paste by means of gas pressure and then treating the paste under heat.

According to this invention, there is still further provided a process for producing a thick film type thermal head having a consecutive constitution, on an insulator substrate, of a heat-resistant layer, an electrode, a heating resistor and a protective layer formed of an electrically insulating protective layer and a heat-diffusing coating, which comprises etching the electrically insulating protective layer covering the heating resistor to form a groove and embedding a substance having high thermal conductivity over the electrically insulating protective layer so as to form the heat-diffusing coating positioned on the heating resistor.

Further, this invention provides a thermal recording device using a thermal head recited in claim 3 and a facsimile device using same.

Figure 1:
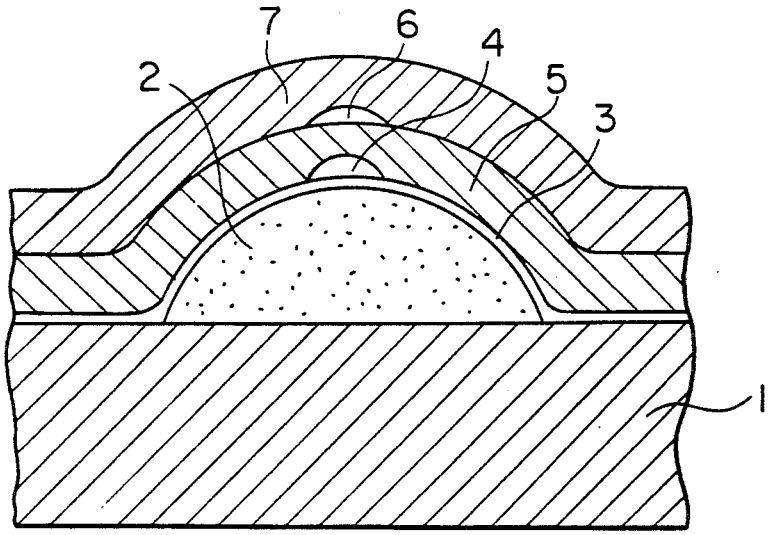
FIG. 1 is a cross sectional view of a thick film type thermal head according to Example 1 of this invention.

DETAILED DESCRIPTION OF THE INVENTION (1) To accomplish the objects of this invention, the protective layer of a thick film type thermal head has a two-layer structure composed of an electrically insulating layer and a heat-diffusing coating.

(2) To improve thermal conductivity, the heat-diffusing coating is constituted of a metal film.

(3) To improve resolution and heat efficiency, the heat-diffusing coating is formed in a band form and in a position above a heating resistor.

(4) To further improve the heat transfer coefficient, the center line of the heat-diffusing coating is so positioned as to deviate toward a coloring medium feeding direction from the center of the heating resistor.

(5) To improve the heat transfer coefficient, the center line of the heating resistor is so positioned as to deviate toward a coloring medium feeding direction with regard to the top portion of the heat-resistant layer.

(6) To achieve good contact between the thermal head surface and the coloring medium, the protective layer contains a topmost protective film having surface smoothness.

(7) To achieve good contact between the thermal head surface and the coloring medium and to remove static electricity caused by friction, the topmost electrically conductive protective layer is imparted with surface smoothness.

(8) To improve the resolution and heat efficiency of the thermal head, the heat-diffusing coating is formed in a band form and in a position above the heating resistor.

(9) To promote the heat diffusion effect of the heat-diffusing coating, the heat-diffusing coating is formed directly on the heating resistor surface.

(10) To improve the heat transfer coefficient, the heat-diffusing coating is constituted of a metal film.

(11) To prevent electric leakage to the heat-diffusing coating in the thermal head an insulating film is formed between the heating resistor and the heat-diffusing coating.

(12) To prevent the heat-diffusing coating from reducing resolution in the thermal head the heat-diffusing coating is divided and formed by etching so as to correspond to pixels from the heating resistor.

(13) To smooth the image quality of a printed image formed by the thermal head the heat-diffusing coating is formed so as to deviate half a pitch with regard to pixels from the heating resistor.

(14) To smooth an image and, at the same, prevent reduction in resolution in the thermal head, the heat-diffusing coating is etched to form patterns in a trapezoid form such that the patterns (dots) are positioned alternately upside down.

(15) To smoothen an image and, at the same, prevent reduction in resolution in the thermal head, the heat-diffusing coating is etched to form patterns in a trapezoid form such that the patterns (dots) are positioned alternately upside down.

(16) To smooth an image and, at the same, prevent reduction in resolution in the thermal head, the heat-diffusing coating is divided and formed into patterns in a parallelogram form by etching.

(17) To smooth an image and, at the same, prevent reduction in resolution in the thermal head, the heat-diffusing coating is divided and formed into patterns in a parallelogram form by etching.

(18) To smooth an insulating protective film surface when a heat-diffusing coating is formed and to achieve good contact between a thermal head and a coloring medium in the thermal head, the heat-diffusing coating is formed by etching the electrically insulating protective layer to form a groove in a band form and embedding a substance having good thermal conductivity.

(19) To smooth an insulating protective film surface when a heat-diffusing coating is formed and to achieve good contact between a thermal head and a coloring medium in the thermal head, the heat-diffusing coating is formed by etching the electrically insulating protective layer to form a groove with a deviation of half a pitch with regard to pixels from a heating resistor, and embedding a substance having good thermal conductivity.

(20) To constitute a thermal head having a simple structure and giving a smooth image quality, a heat-resistant layer, a lower electrode, a heating resistor, an upper electrode and a protective layer are consecutively laminated on an insulator substrate, whereby the direction of current in the resistor is the direction of the lamination.

(21) To constitute a thermal recording device having good heat efficiency, the thick film type thermal head is mounted on a thermal recording device.

(22) To constitute a facsimile device having good heat efficiency, the thick film type thermal head is mounted on a facimile device.

In thermal heads, mentioned above portions between heating resistors forming pixels for printing generate no heat due to arrangement of electrodes, and such portions sometimes appear in a print as a undesirable white streak. However, when the above-specified film structure is used as a protective film for the thermal head, generated heat is diffused in a thermally conductive coating, and a low-temperature area, i.e. a non-coloring portion from the thermal head is removed. Therefore, the white streak which deteriorates image quality does not occur. The heat-diffusing coating accomplish good heat transfer from the thermal head to a coloring medium, and the use of the above thermal head therefore makes it possible to constitute a thermal recording device having good thermal efficiency.

DESCRIPTION OF PREFERRED EMBODIMENTS

This invention will be explained hereinbelow by reference to Examples.

(1) Example 1 of this invention will be explained with reference to FIGS. 1, 2, 3, 17 and 18.

Figure 17:
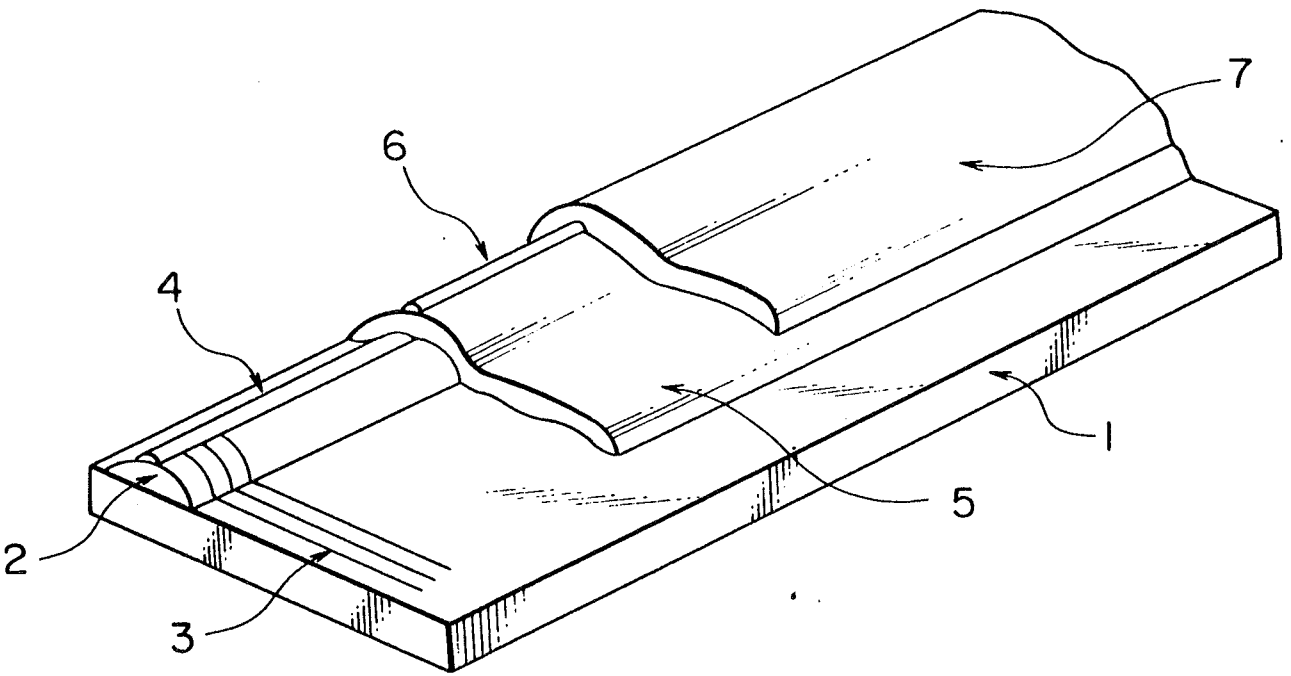
FIG. 17 is a perspective view showing a thermal head in Example 1.

A thermal head is constituted as follows. A partially glazed layer 2 as a heat-resistant layer, an electrode 3, and a thick film resistor 4 containing as a main component a metal or a metal oxide and glass are consecutively laminated on an alumina substrate 1. An insulating protective layer 5 is further formed on the thick film resistor 4, and a metal film 6 as a heat-diffusing coating is formed thereon in a band form such that it is positioned above the thick film resistor 4. The metal film 6 is formed by printing a paste containing glass particles and an organic binder in addition to 80 to 99% by weight of gold, silver or copper and having a viscosity of 20 to 100 kcps by using a screen printing machine, drying it and firing it such that the dried and fired film has a thickness of 1 to 3 μm and a pattern width, in the subscanning direction, of 50 to 150% of the width of the heating resistor. Further, a 2 to 15 μm thick surface protective layer 7 which has a smooth surface and is imparted with electrical conductivity by incorporating 5 to 15% by weight of $RuO_2$ is formed as a topmost layer. FIG. 17 is a perspective view of a cross section of the thermal head of this Example.

The above thermal head is produced as follows.

Figure 2:
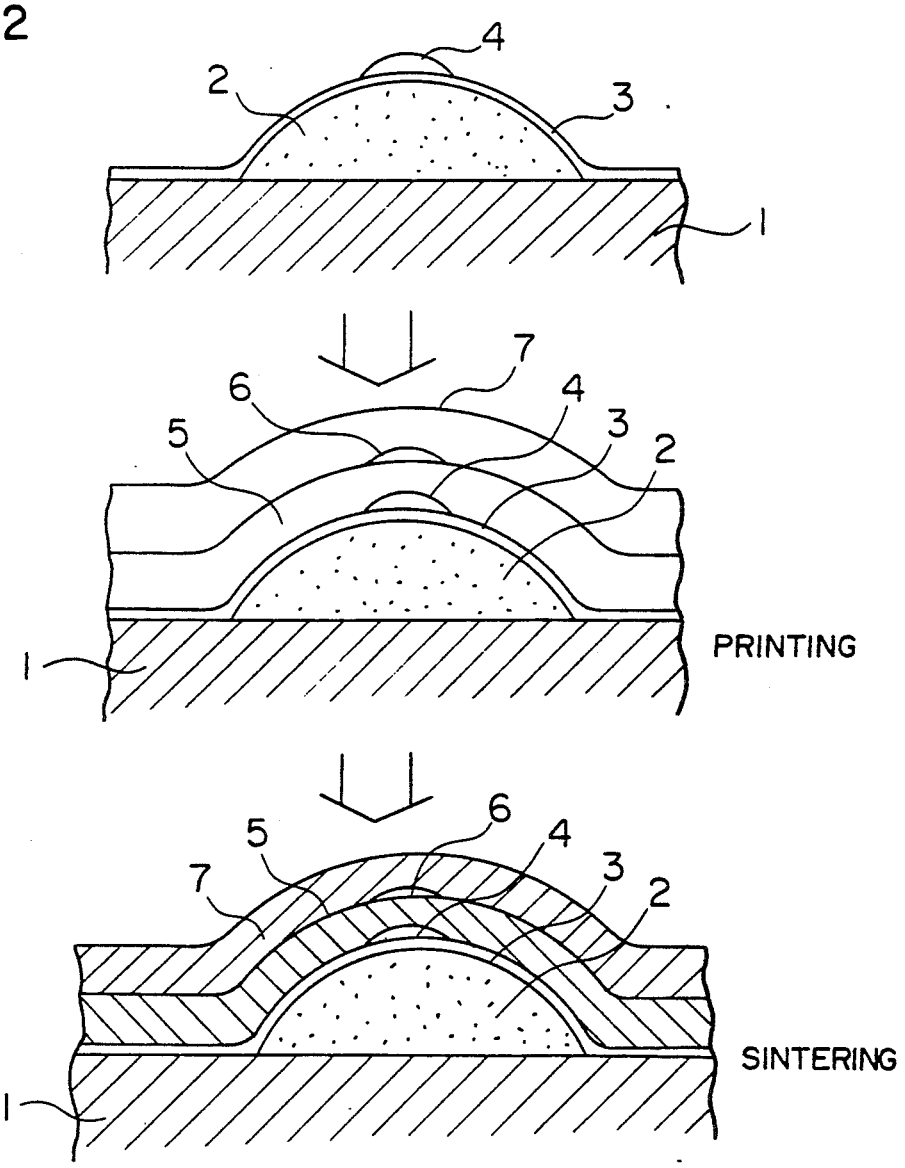
FIGS. 2 and 3 are cross sectional views of a thermal head showing a process in Example 1.
Figure 3:
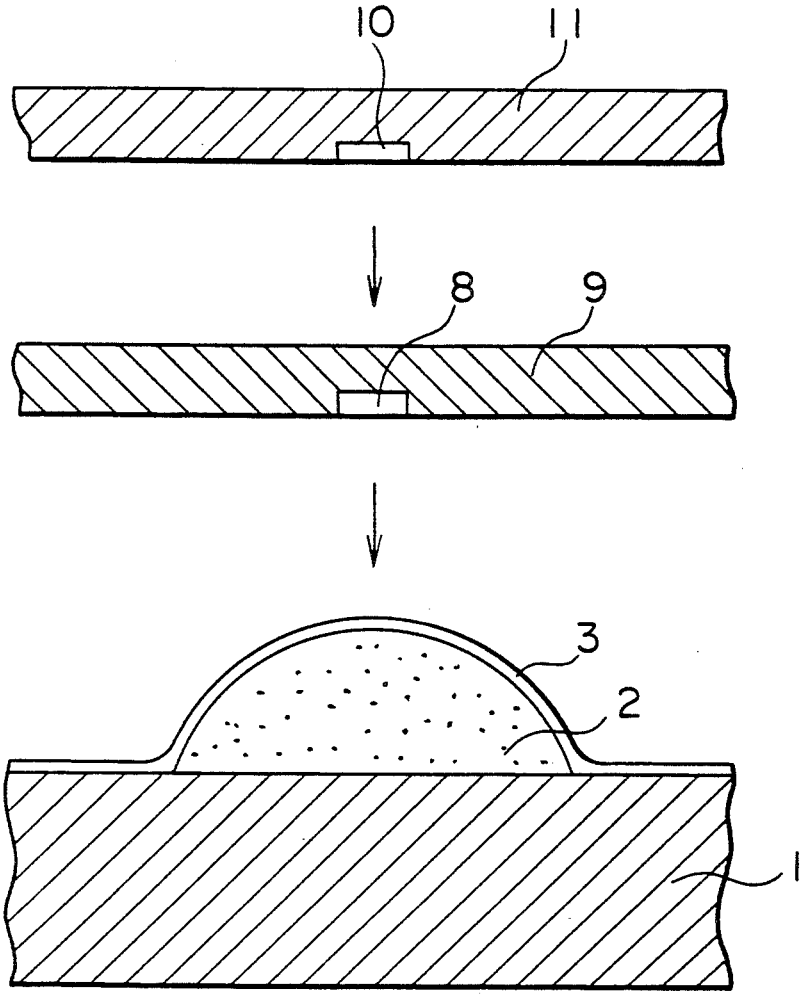

As shown in FIG. 2, the partially glazed layer 2, the electrode 3 and the thick film resistor 4 are consecutively formed on the alumina substrate 1 in the same procedure as above. The insulating protective layer 5, the metal film 6 and, further, a surface protective layer 7 are respectively formed by a screen printing method and dried, and then, these layers and film are fired at one time to form a protective layer. Otherwise, as shown in FIG. 3, the partially glazed layer 2 and the electrode 3 are formed on the alumina substrate 1, and then a green sheet 9 of an insulating protective layer in which a thick film resistor 8 in a band form is embedded is printed thereon. Further, a green sheet 11 of a surface protective layer in which a metal film 10 in a band form is embedded is printed, and the resultant product is fired to form a protective layer. These processes for forming the protective layer simplify the process for forming a thermal head.

Figure 18:
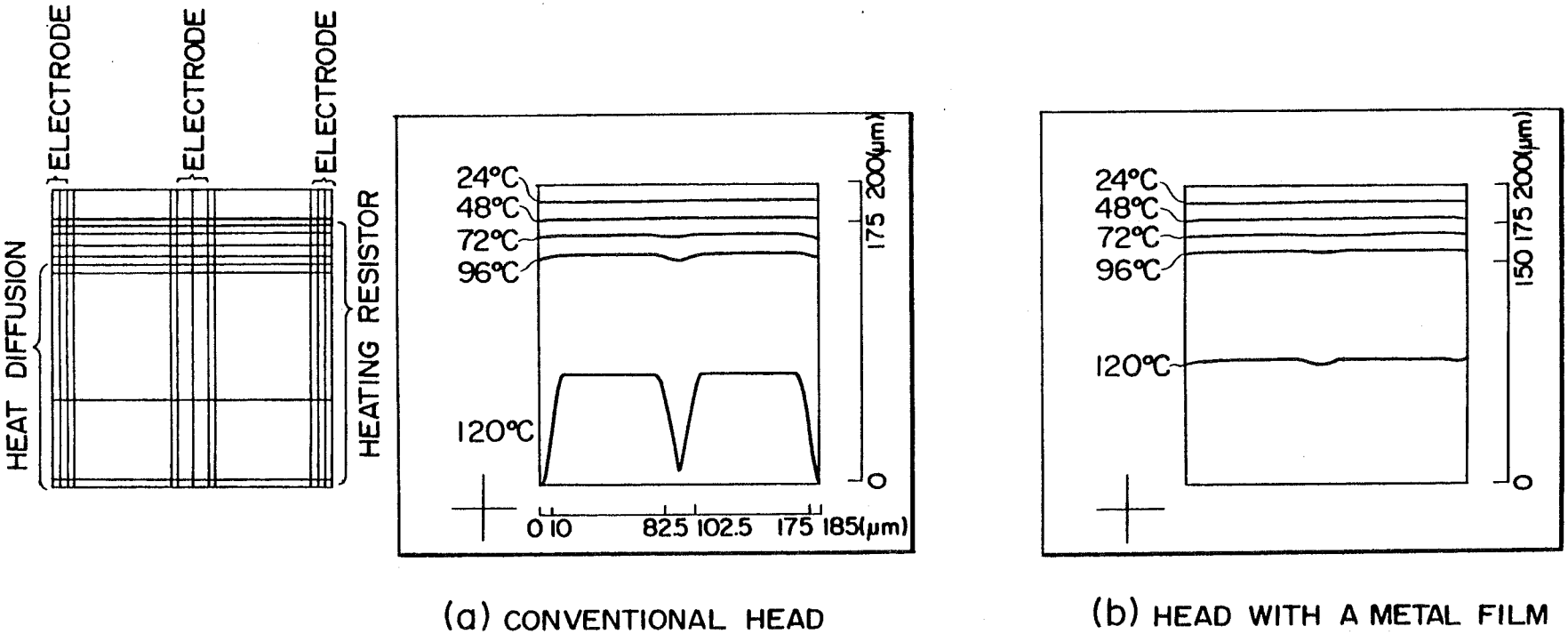
FIG. 18 shows a comparison in temperature distribution on a thermal head surface between an improved model of a thermal head having a metal film of gold and a thermal head having a conventional structure.

When a voltage is applied to the electrode 3 of the above thermal head according to a printing signal to heat the thick film resistor 4, Joule's heat generated in 4 is propagated through the protective layer 5. The alternate lead method electrode structure generally used in thick film type thermal heads shows a temperature distribution in which that portion of the surface of the resistor 4 which is positioned directly above the electrode 3 has a lower temperature than an interelectrode portion, since the portion positioned directly above the electrode 3 in the resistor 4 does not generate heat due to absence of electric current. Glass is generally used as the protective layer 5. Since, however, glass has a thermal conductivity of as low as 0.5 to 0.6 W/m.k, heat is not diffused in an in-plane direction, and the temperature distribution of the thick film resistor 4 is maintained up to an interface between the protective layer 5 and the metal layer 6. Meanwhile, gold, silver and copper as the metal film 6 have a high thermal conductivity, that is, gold has a thermal conductivity of about 320 W/m.k, silver has that of about 430 W/m.k, and copper has that of about 400 W/m.k. Therefore, the heat is diffused in an in-plane direction, and a nonuniform heat distribution caused by the resistor 4 is uniformly transferred to the surface of the surface protective layer 7, i.e. a thermal head surface, i.e. pixel dots are expanded when printing. Hence, a smooth image can be outputted. FIG. 18 shows a comparison of temperature distribution between an improved model of a thermal head having a metal film of gold and a thermal head having a conventional structure. The Figure shows that the improved model has a smooth temperature distribution as compared with a thermal head having a conventional structure. In thermal heads used for the comparison, the resistors had a width of 350 μm, and the metal films had a width of 300 μm and a thickness of 22 μm. As a material for the metal film 6, nonmetallic substances having high thermal conductivity are also usable besides the above gold, silver and copper. Table 1 shows a list of such materials including metals and nonmetals.

TABLE 1

| Substance (Measurement temperature) | Thermal conductivity |
|---|---|
| Gold (0° C.) | 319 W/m · K |
| Silver (0° C.) | 428 |
| Copper (0° C.) | 403 |
| Tungsten (0° C.) | 177 |
| Aluminum (0° C.) | 236 |
| Berylium (0° C.) | 218 |
| Brass*1 (0° C.) | 106 |
| Gunmetal*2 (0° C.) | 180 |
| Silicon (ordinary temperature) | 84 |
| Germanium (25° C.) | 59 |
| Alumina (ordinary temperature) | 21 |

In this Example, the metal film 6 is formed in a band form along the thick film resistor 4. Hence, the heat is not diffused in the subscanning direction, and the reduction in resolution can be prevented. The surface protective layer 7 formed as a topmost layer has the effects of achieving good contact between the thermal head surface and the coloring medium and removing static electricity generated by friction between the thermal head and the coloring medium. Therefore, the thermal head of this Example has an effect of preventing electrostatic destruction of the thick film resistor 4.

Figure 4:
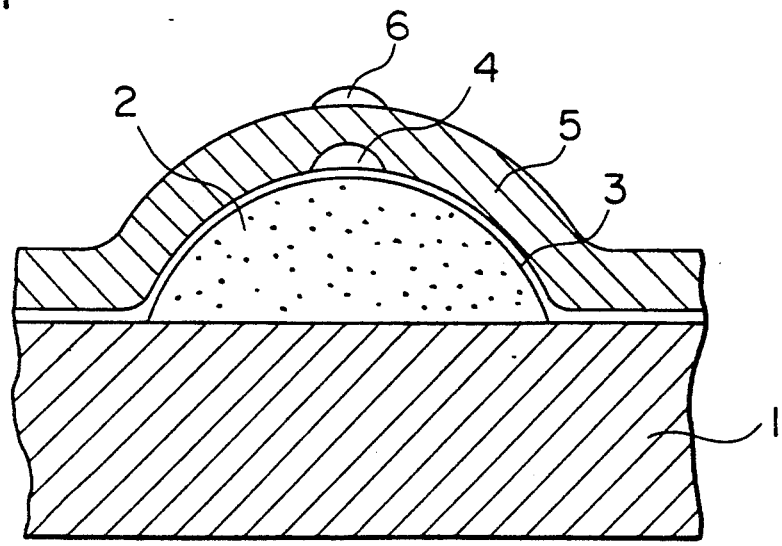
FIG. 4 is a cross sectional view of a thermal head in Example 2.

(2) Example 2 of this invention is explained below with reference to FIG. 4.

A partially glazed layer 2, an electrode 3 and a thick film resistor 4 are consecutively formed on an alumina substrate 1 in the same way as in Example 1. Then, an insulating protective layer 5 is formed, and further, a paste containing glass particles and an organic binder on the basis of 80 to 99% by weight of gold, silver or copper is printed to form a metal film 6 by using a screen printing machine such that a dried and fired film has a thickness of 1 to 3 μm and that the pattern width in a subscanning direction is 50 to 150% of the heating resistor width. The metal film 6 is formed in a band form such that it is positioned above the thick film resistor. According to this Example, the quality of a printed image is smoothen due to the heat diffusion effect of the metal film 6, and the metal film 6 is brought into contact directly with a coloring medium. Therefore, there is an effect of improving the thermal efficiency of a thermal head.

Figure 5:
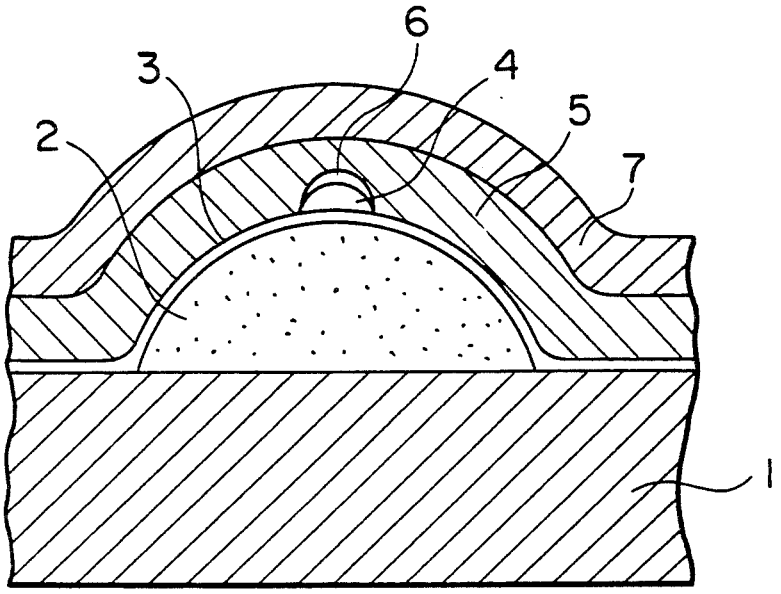
FIG. 5 is a cross sectional view of a thermal head in Example 3.

(3) Example 3 is explained below with reference to FIG. 5.

A partially glazed layer 2, an electrode 3 and a thick film resistor 4 are consecutively formed on an alumina substrate 1. A metal film 6 is further formed on resistor 4, and a surface protective layer having a smooth surface and electrical conductivity is formed thereon as a topmost layer to give a thermal head. According to this Example, Joule's heat generated in the thick film resistor 4 is directly transferred to the metal film 6 and diffused. Therefore, there are effects of expanding pixels at time of printing and smoothing image quality.

Figure 6:
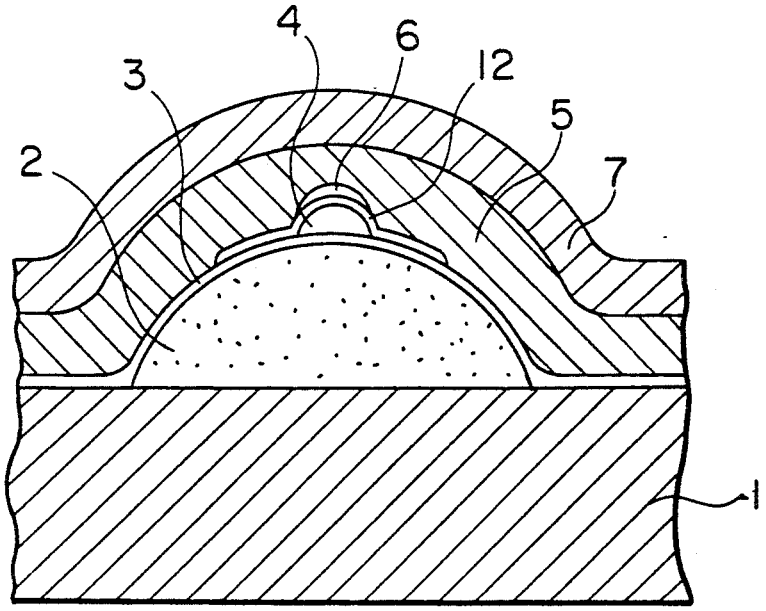
FIG. 6 is a cross sectional view of a thermal head in Example 4.

(4) Example 4 is explained below with reference to FIG. 6.

A thermal head is produced in the same way as in Example 3 except that an electrically insulating coating 12 is formed between thick film resistor 4 and metal film 6. The electrically insulating coating 12 is formed from a glass paste by using a screen printing machine such that the fired thickness is 1 to 3 μm. According to this Example, the pixel dots are expanded, and then the resistor 4 and the metal film 6 are electrically separated. Hence, current applied to the resistor 4 does not flow into the metal film 6. Therefore, there is the effect that the resistance value of the thermal head can be easily adjusted.

Figure 7:
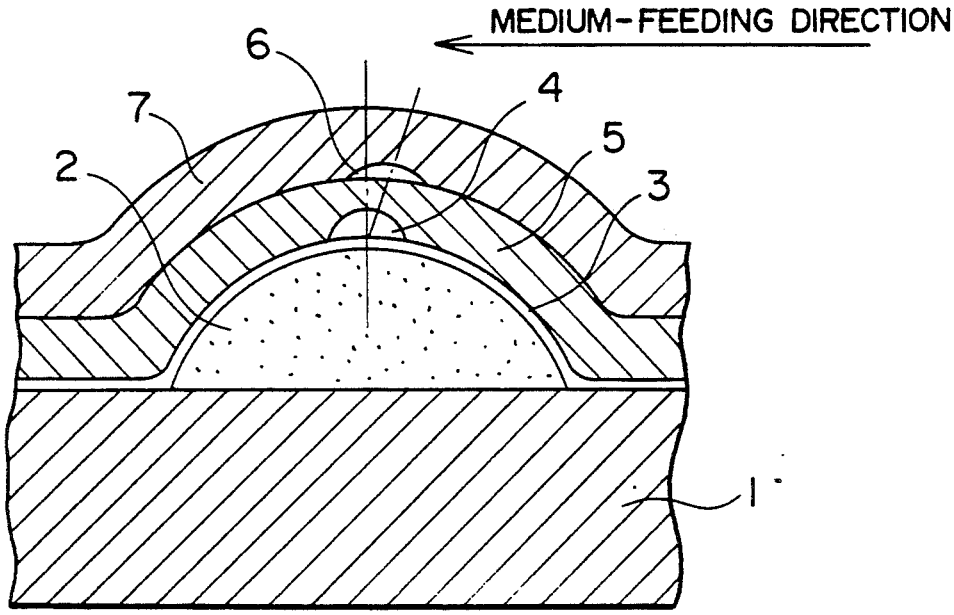
FIG. 7 is a cross sectional view of a thermal head in Example 5.

(5) Example 5 is explained below with reference to FIG. 7.

A partially glazed layer 2, an electrode 3, a thick film resistor 4 and an insulating protective layer 5 are formed on an alumina substrate 1 in the same way as in Example 1. Then, a metal film 6 is formed on the protective layer 5 in a band form such that it is positioned above the resistor 4, and further, a surface protective layer which is imparted with electrical conductivity by incorporating $RuO_2$ and which contains glass as a main component is formed thereon as a topmost layer. However, the center line of the metal film 6 is positioned somewhere between the cross-sectionally central portion of the resistor 4 and that end of the resistor which is present on the medium-feeding side. That is, the metal film is so positioned as to deviate toward the medium feeding side. When there is used a method of bringing a coloring medium such as a thermosensitive paper sheet or a combination of an ink film with a heat transfer paper sheet into contact with a thermal head to develop color(s) by using a rubber roller, the portion which is brought into contact with the coloring medium is only that portion of a convex portion above the resistor which is present on the color-developing paper sheet feeding side. For this reason, the metal film 6 is so positioned as to deviate toward the coloring medium feeding side as is done in this Example, whereby heat transfer from the thermal head to the thermosensitive paper sheet can be easily effected.

Figure 8:
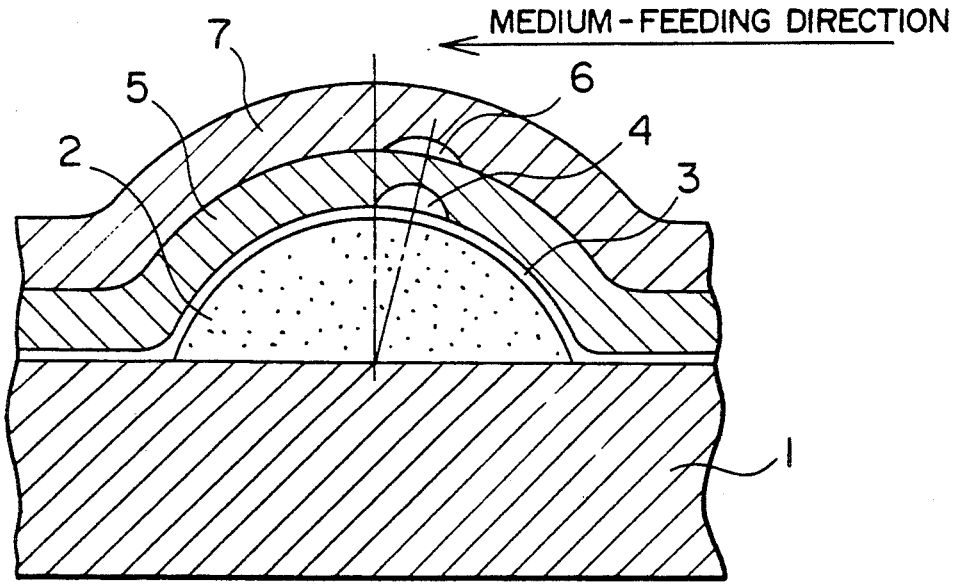
FIG. 8 is a cross sectional view of a thermal head in Example 6.

(6) Example 6 is explained below with reference to FIG. 8.

A partially glazed layer 2, an electrode 3, a thick film resistor 4 and an insulating protective film 5 are formed on an alumina substrate in the same way as in Example 1. Then, a metal film 6 is formed on the protective layer 5 in a band form such that it is positioned above the resistor 4. Further, a surface protective layer 7 having a smooth surface and electrical conductivity is formed as a topmost layer. However, the thick film resistor 4 is so positioned as to deviate toward the coloring medium feeding side, and the metal film 6 is also so positioned as to deviate from the cross-sectionally central portion of the resistor 4 to the coloring medium feeding side. In this case, however, the position of the center line of the thick film resistor deviates from the center line of the partially glazed layer only by the width of the thick film resistor a maximum, and the center line of the metal film also deviates up to an end position of the thick film resistor at a maximum. This Example produces the effect that the efficiency of heat transfer from the thermal head to the coloring medium is improved.

Figure 9:
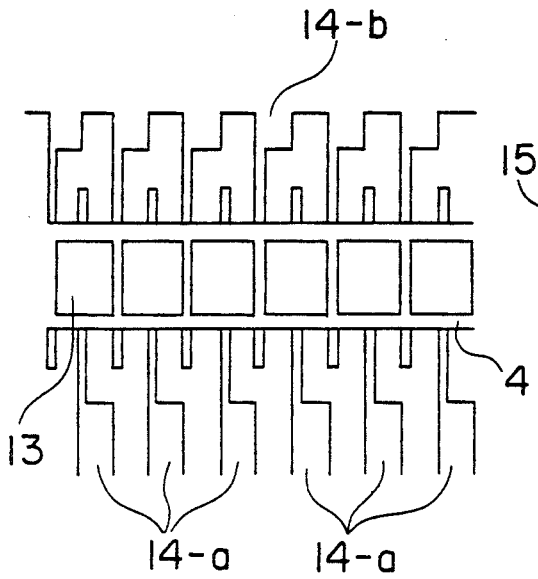
FIG. 9 shows a pattern arrangement in Example 7.

(7) Example 7 is explained below by reference to FIG. 9.

A partially glazed layer, electrodes 14, a thick film resistor 4 and an insulating protective layer are formed on an alumina substrate, and a metal film 13 is formed on the resistor 4 in a band form such that it is positioned above the resistor 4. Further, as shown in FIG. 9, the metal film 13 is etched to form patterns corresponding to pixel dots at printing time. In addition, the distance between the adjacent metal films locations in the sub-scanning direction is adjusted to 5 to 30 μm. When the metal film 13 containing gold as a main component is etched, a photoresist is applied to the metal film in a band form by using a roll coater or a spinner, and then the photoresist is exposed to a ultrahigh-pressure mercury lamp for 10 to 30 seconds through a photomask corresponding to the intended form of the metal film 13, and further, developed in a developer. The resultant product is allowed to stand in an etching solution containing ammonium iodide, iodine and water for 20 seconds to 1 minute to carry out patterning. In an alternate lead system generally used in thick film thermal heads, each of separate electrodes 14-*a* corresponds to the center of each of pixel dots, and a common electrode 14-*b* corresponds to a boundary between pixel dots. Therefore, a square pattern of the metal film 13 shown in FIG. 9 has its center above 14-*a*. After the patterning of the metal film 13, a surface protective layer having a smooth surface and electrical conductivity is formed as a topmost layer to give a thermal head. According to this Example, it is possible to prevent diffusion of heat to adjacent dots when pixels are expanded, i.e. it is possible to prevent a reduction in resolution in the main scanning direction.

Figure 10:
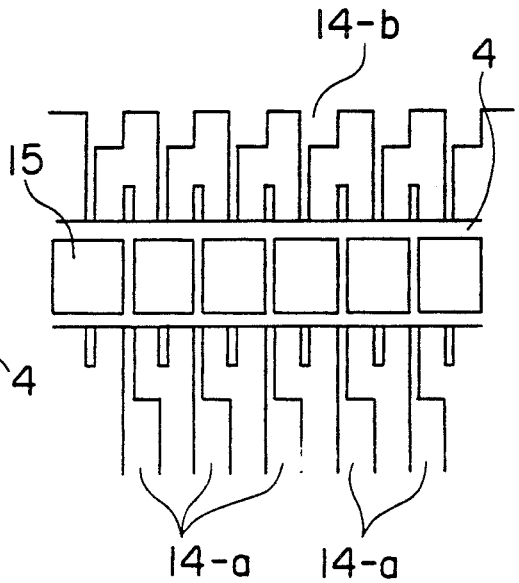
FIG. 10 shows a pattern arrangement in Example 8.

(8) Example 8 is explained below by reference to FIG. 10.

A metal film 15 is formed by deviating the pattern of the metal film of Example 7 toward the main scanning direction by half a pitch. Therefore, the center of each of the square patterns of the metal film is positioned above the boundary between pixel dots. According to this Example, the pixel dots are expanded in the boundary between adjacent dots as well to smooth the image, and, further, diffusion of heat to adjacent pixel dots is prevented. Hence, there is an effect of preventing reduction in resolution.

Figure 11:
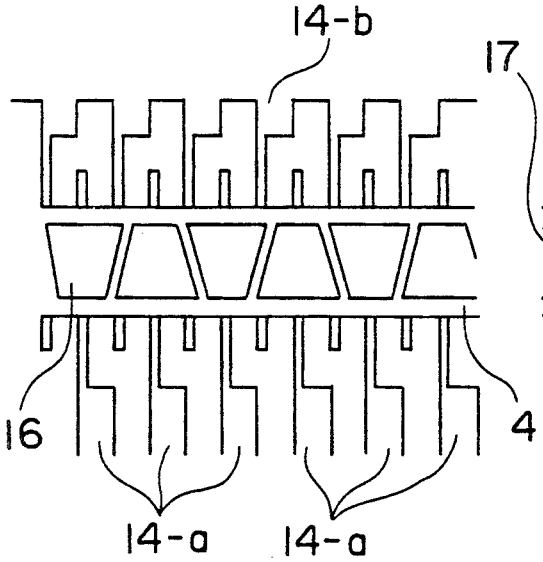
FIG. 11 shows a pattern arrangement in Example 9.

(9) Example 9 is explained below with reference to FIG. 11.

A metal film 16 is formed by changing the divided pattern of the metal film of Example 7 to trapezoid patterns, and the trapezoid patterns are arranged alternately upside down. According to this Example, that heat-nondeveloping portion of the heating resistor which is positioned directly above the electrode is fully covered with a metal film 16, whereby an image is smooth and, further, diffusion of heat to adjacent dots is prevented. There is therefore an effect of preventing reduction of resolution.

Figure 12:
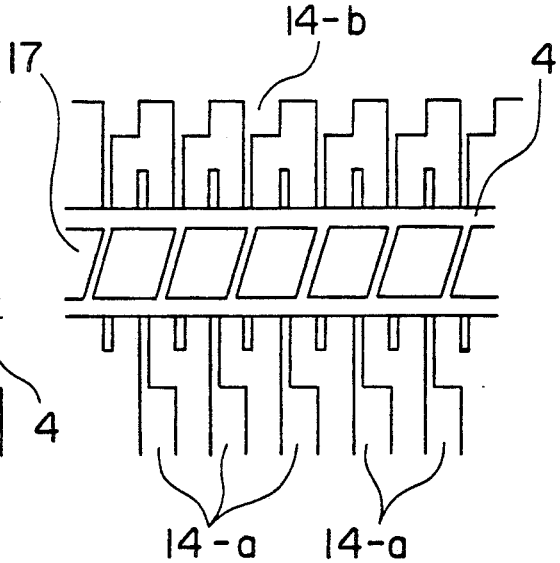
FIG. 12 shows a pattern arrangement in Example 10.

(10) Example 10 is explained below with reference to FIG. 12.

A metal film 17 is formed by changing the divided patterns of the metal film of Example 7 to parallelogram patterns. According to this Example, that heat-non-developing portion of the heating resistor which is positioned directly above the electrode is fully covered with a metal film 17, whereby an image is smoothed and, further, diffusion of heat to adjacent dots is prevented. There is therefore an effect of preventing reduction of resolution.

Figure 13:
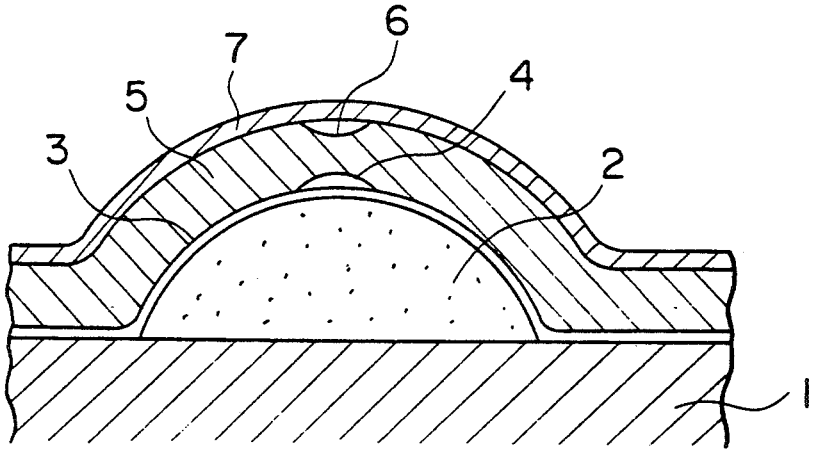
FIG. 13 is a cross sectional view of a thermal head in Example 11.

(11) Example 11 is explained below with reference to FIG. 13.

A partially glazed layer 2, an electrode 3, a thick film resistor 4 and an insulating protective layer 5 are consecutively formed on an alumina substrate 1. A groove having a depth of 1 to 3 μm and a width of 50 to 150% of the thick film resistor is formed by etching or machining that portion of the protective from 5 which is positioned directly above the resistor 4. A metal film 6 is embedded in the groove, and coating treatment is effected on the surface to smooth the surface. Thereafter, a surface protective layer 7 having a smooth surface and electrical conductivity is formed to give a thermal head. According to this Example, even if the thickness of the surface protective layer 7 is reduced, surface smoothness can be maintained. Therefore, there is an effect of improving efficiency of heat transfer from the metal film 6 to a coloring medium.

(12) Example 12 is explained below with reference to FIG. 14.

Figure 14:
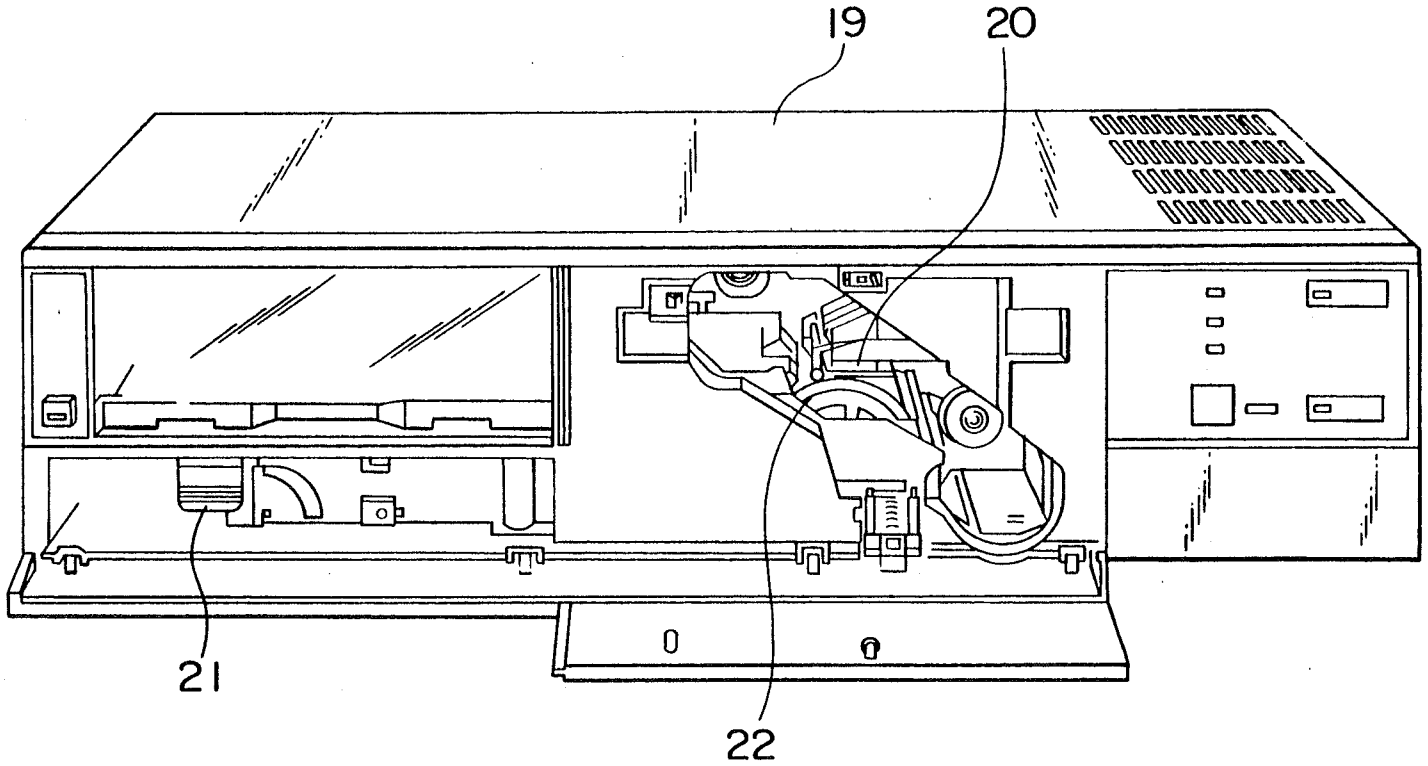
FIG. 14 is a perspective view of a device in Example 12.

FIG. 14 shows a recording device using any one of the thermal heads of Examples 1 to 11. In FIG. 14, the thermal head numbered as 20 is set within a device 19, and a recording sheet fed from a recording sheet cassette 21 is heated on a platen roller 22 together with a heat transfer ink film by means of the thermal head 20, whereby a print is made. According to this Example, a thermal recording device capable of giving an image having smooth print quality can be constituted, and further, there is an effect of improving heat efficiency of the thermal recording device itself.

(13) Example 13 is explained below with reference to FIG. 15.

Figure 15:
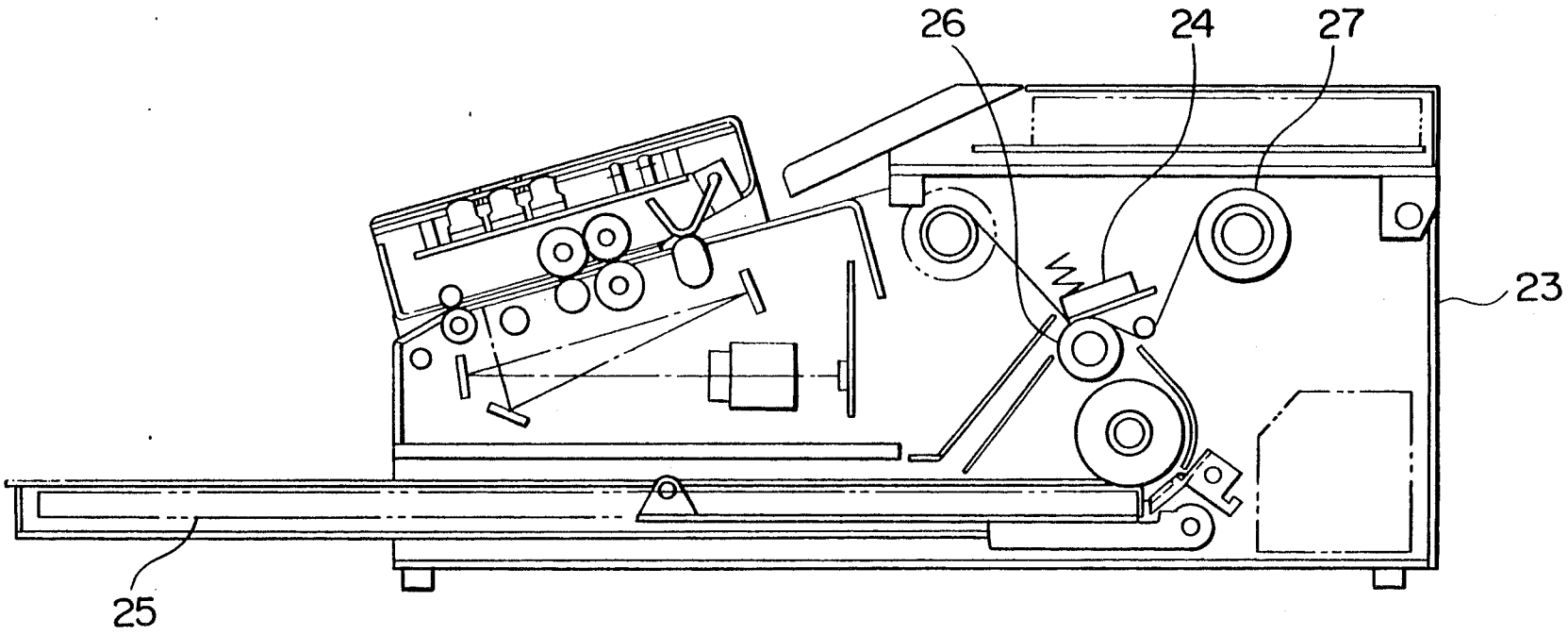
FIG. 15 is a cross sectional view of a device in Example 13.
Figure 16:
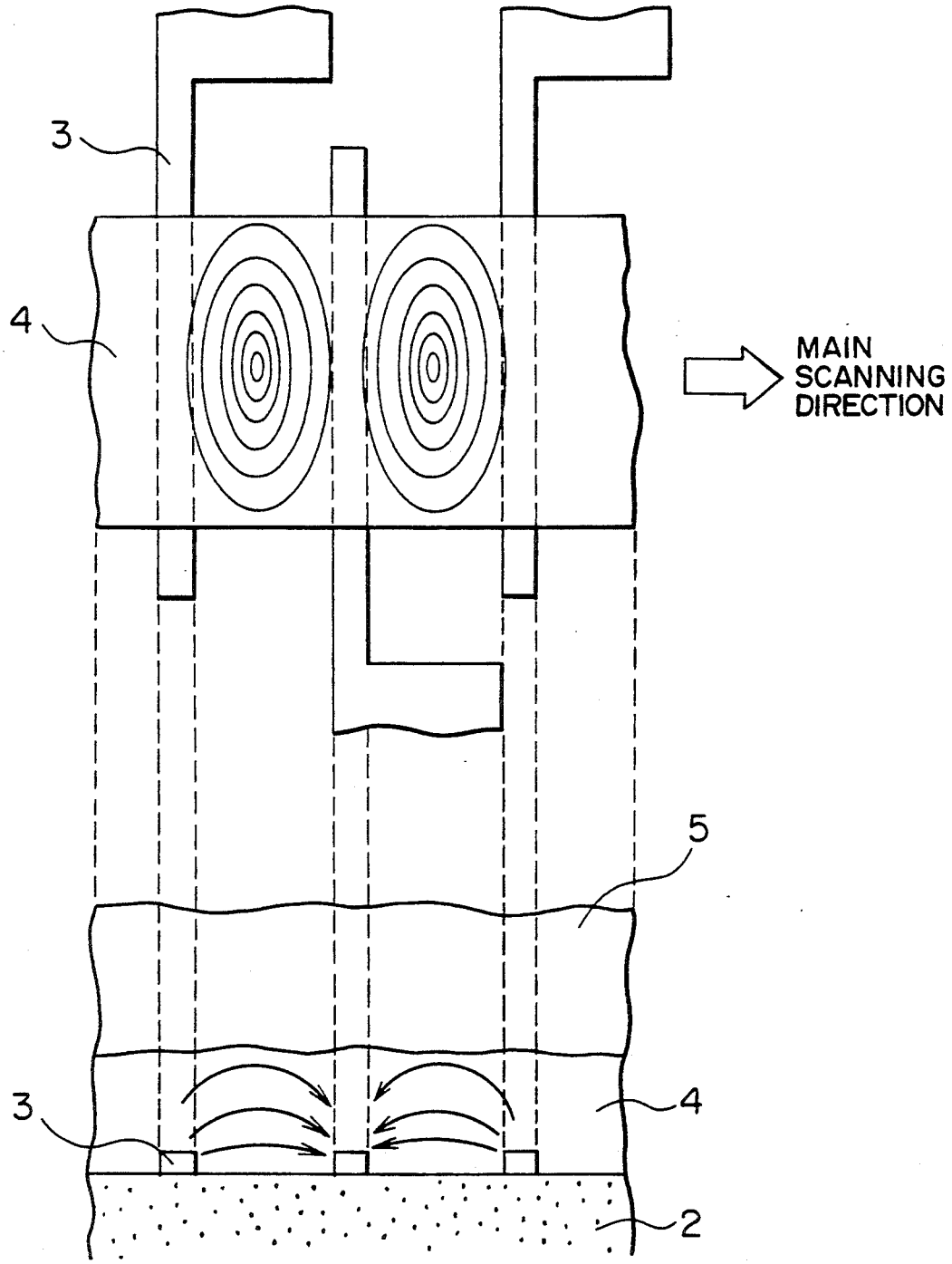
FIG. 16 shows an isothermic line distribution on a thermal head resistor according to a conventional technique.

FIG. 15 shows a facsimile device using any one of the thermal head of Examples 1 to 11. In FIG. 15, the thermal head numbered 24 is set within a device 23, and a recording sheet fed from a recording sheet cassette 25 is pressed onto the thermal head together with a heat transfer ink film 27 by means of a platen roller 26 and heated by means of the thermal head 24 according to image signals arriving through a line, whereby an image is recorded. According to this Example, a thermal recording device capable of giving an image having smooth print quality can be constituted, and further, there is an effect of improving heat efficiency of the thermal recording device itself.

As specified above, this invention produces effects that the temperature distribution within each of pixels can be made uniform, and that a printed smooth image can be therefore obtained without any reduction in resolution.

What is claimed is:

1. A thick film type thermal head produced by consecutively forming, on an insulator substrate, a heat-resistant layer, an electrode, a heating resistor and a protective layer, wherein the protective layer comprises an electrically insulating protective layer covering the heating resistor and a heat-diffusing coating disposed on a surface portion of the electrically insulating protective layer corresponding to a medium and opposite to a surface of the electrically insulating protective layer directly contacting the heating resistor, the heat-diffusing coating having a higher thermal conductivity than the electrically insulating protective layer.

2. A thick film type thermal head according to claim 1, wherein the heat-diffusing coating is constituted of a metal film.

3. A thick film type thermal head according to claim 2, wherein the heat-diffusing coating is formed in a band form such that the heat-diffusing coating is positioned above the heating resistor.

4. A thick film type thermal head according to claim 2, which further has a protective film having electrical conductivity as a topmost film on the heat-duffusing coating.

5. A thick film type thermal head according to claim 4, wherein the protective film having electrical conductivity comprises a smooth surfaced protective film.

6. A thick film type thermal head according to claim 4, wherein the heat-diffusing coating is formed in a band form such that it is positioned above the heating resistor.

7. A thick film type termal head according to claim 6, wherein the heating resistor corresponds to pixels and the heat-diffusing coating intermediately present is an etched coating forming divided parallelogram patterns corresponding to pixels from the heating resistor.

8. A thick film type thermal head according to claim 3, wherein the heating resistor corresponds to pixels and the heat-diffusing coating is divided and formed by etching so as to correspond to pixels from the heating resistor.

9. A thick film type thermal head according to claim 3, wherein the heating resistor corresponds to pixels and the heat-diffusing coating is divided and formed by etching so as to deviate by half a pitch with regard to pixels from the heating resistor.

10. A thick film type thermal head according to claim 3, wherein the heat-diffusing coating is an etched coating forming trapezoid patterns alternately arranged upside down.

11. A thick film type thermal head according to claim 3, wherein the heating resistor corresponds to pixels and the heat-diffusing coating is an etched coating forming divided parallelogram patterns corresponding to pixels from the heating resistor.

12. A thick film type thermal head according to claim 1, wherein the heat-diffusing coating is constituted of a gold, silver or copper film.

13. A thick film type thermal head produced by consecutively forming, on an insulator substrate, a heat-resistant layer, an electrode, a heating resistor and a protective layer, wherein the protective layer comprises an electrically insulating protective layer covering the heating resistor and a heat-diffusing metal film coating formed as a band and disposed on a surface portion of the electrically insulating protective layer corresponding to a medium and opposite to a surface of the electrically insulating protective layer directly contacting the heating resistor, the heat-diffusing coating having a higher thermal conductivity than the electrically insulating protective layer and being positioned above the heating resistor such that the heat-diffusing coating has a center line deviating toward a side on which a coloring medium consisting of a heat transfer ink film and a recording sheet or a thermal sheet is fed.

14. A thick film type thermal head produced by consecutively forming, on an insulator substrate, a heat-resistant layer, an electrode, a heating resistor and a protective layer, wherein the protective layer comprises an electrically insulating protective layer covering the heating resistor and a heat-diffusing metal film coating formed as a band and disposed on a surface portion of the electrically insulating protective layer corresponding to a medium and opposite to a surface of the electrically insulating protective layer directly contacting the heating resistor, the heat-diffusing coating having a higher thermal conductivity than the electrically insulating protective layer and being positioned above the heating resistor, the heating resistor having a center line deviating toward a coloring medium feeding side with regard to a top portion of the heating resistor.

15. A thick film type thermal head produced by consecutively forming, on an insulator substrate, a heat-resistant layer, an electrode, a heating resistor and a protective layer, wherein a heat-diffusing coating constituted of an electrically conductive metal film is formed as a band on the heating resistor, and the protective layer is formed on the heat-diffusing coating, and an electrically insulating film is formed in a boundary between the heating resistor and the heat-diffusing coating to prevent current from flowing into the heat-diffusing coating.

* * * * *